US005647411A

United States Patent [19]

Koppe et al.

[11] Patent Number: 5,647,411

[45] Date of Patent: Jul. 15, 1997

[54] METERING METHOD AND DEVICE

[75] Inventors: Klaus-Dieter Koppe; Michael Krapalis, both of Norderstadt, Germany

[73] Assignee: Fluid Management, Inc., Wheeling, Ill.

[21] Appl. No.: 605,092

[22] PCT Filed: Sep. 13, 1994

[86] PCT No.: PCT/EP94/03042

§ 371 Date: Mar. 8, 1996

§ 102(e) Date: Mar. 8, 1996

[87] PCT Pub. No.: WO95/08098

PCT Pub. Date: Mar. 23, 1995

[30] Foreign Application Priority Data

Sep. 15, 1993 [DE] Germany ..... 43 31 924.6

[51] Int. Cl.[6] ..... B65B 1/04

[52] U.S. Cl. ..... 141/83; 141/87; 141/91; 239/106; 15/4

[58] Field of Search ..... 141/83, 86, 87, 141/89, 90, 91; 15/256.5, 246, 4, 97.1; 239/106, 110, 112, 114, 120, 123

[56] References Cited

U.S. PATENT DOCUMENTS

| | | | |
|---|---|---|---|
| 3,468,248 | 9/1969 | Giori | 15/4 |
| 4,076,503 | 2/1978 | Atwood et al. | 141/90 |
| 4,469,148 | 9/1984 | Vogele et al. | 141/87 |

FOREIGN PATENT DOCUMENTS

| | | |
|---|---|---|
| 39 08 453 A1 | 9/1990 | Germany . |
| 516 897 A1 | 12/1992 | Germany . |

*Primary Examiner*—Henry J. Recla
*Assistant Examiner*—Steven O. Douglas
*Attorney, Agent, or Firm*—Fitch, Even, Tabin & Flannery

[57] ABSTRACT

A method and apparatus for metering highly viscous, paste-like material, in particular printing ink, e.g. offset printing ink, from a metering valve. The metering valve in dependence upon the determined quantity of material delivered into a container is closed and then the residual material left suspended at the outlet side of the metering valve is removed by a roller.

11 Claims, 2 Drawing Sheets

METERING METHOD AND DEVICE

BACKGROUND OF THE INVENTION

The invention relates to a method of metering highly viscous, paste-like material, in particular printing ink, e.g. offset printing ink, from a metering valve, wherein the metering valve in dependence upon the determined quantity of material delivered into a container or the like is closed and then the residual material left suspended at the outlet side of the metering valve is removed, as well as to a metering device for metering highly viscous, paste-like material.

Metering highly viscous, paste-like material which, for example, has a viscosity in excess of 2000 pascal/sec is difficult in practice, as becomes particularly clear, for example, when attempting to meter different offset printing inks into a container in such a way that the mixed product obtained is of a precisely defined shade of colour.

It is known to supply highly viscous, paste-like materials in the form of offset printing inks from drum-shaped containers under high pressure each to a metering valve, from which a stream or strand of the material is then discharged into a container coupled to a weighing device, so that the metering process, generally controlled by a computer, is terminated when the preselected quantity of material has been discharged from the metering valve. The offset printing inks of other colour shades are correspondingly discharged via further metering valves into the container to thereby obtain the desired mixture of material of a preselected colour shade.

While good control of the metering valve may be achieved despite the high viscosity of the paste-like material being discharged, so that the desired quantity of material is metered with sufficient accuracy into the container or the like, a considerable problem is presented by the fact that, after closure of the metering valve, a certain amount of residual material is left suspended from its underside, the quantity depending on the composition of the material, the ambient temperature or the like, i.e. not being precisely defined. Apart from the fact that the discharge of said residual material into the container containing the metered material leads to an inaccuracy which may considerably alter the mixing ratio, it is also extremely difficult to remove said residual material from the underside of the valve.

In practice, removal of the residual material is frequently effected with the aid of a spatula, to which, however, the residual material then adheres and has to be scraped off by hand at a receiving container. The residual material is therefore generally left clinging to the edge of the receiving container and contaminates said container, making it no longer easy to close with a lid.

An attempt has already been made to remove the residual material by providing air nozzles in the region of the underside of the metering valve in order to use the air jets exiting from such nozzles to detach the residual material suspended from the underside of the metering valve. Apart from the fact that this would, at best, lead to the substantially unknown quantity of residual material additionally falling into the container already containing the desired quantity of material and hence invalidating the metering, in many cases owing to the irregular action of the air jets an approximately lateral spinning-away of the residual material was effected so that the residual material fell outside of the region of the container onto the floor or even soiled the clothing of the operator. Stains caused by printing ink in particular are extremely stubborn and are removable, if at all, only with great difficulty.

SUMMARY OF THE INVENTION

The object of the invention is to provide a simple and effective way of removing the residual material which, when metering highly viscous, paste-like materials, is left suspended from the metering valve after closure.

To achieve said object, according to the invention a method of the type described initially is improved in such a way that, for removal of the residual material, a roller disposed just below and to one side of the metering valve is brought into contact with the residual material, the roller rotating about its substantially horizontal longitudinal axis in such a way that the peripheral region of the roller coming into contact with the residual material moves in an upward direction.

With said method, removal of the residual material suspended from the underside of the metering valve is therefore effected in that, immediately after closure of the metering valve, the surface of a rotating roller is brought, as close to the underside of the metering valve as possible but without touching it, into contact with the residual material which then adheres to the roller surface and as a result of the upward movement of the contact region of the roller surface is conveyed in an upward direction. Thereby a type of winding-on movement of the residual material occurs, until even the bottom end of the suspended residual material is gripped and carried away by the roller, as well as a lateral detachment from the underside of the metering valve.

Tests have shown that residual material in the form of offset printing ink adheres extremely well to, and may be transported away by the smooth surface of a steel roller. Both the structure and the material of the roller surface, as well as the roller diameter and the rotational speed depend, however, on the residual material in question and its actual state and may be optimally selected by trials.

To prevent the build-up on the roller surface of a thick layer of residual material which, on the one hand, could impede the continued take-up of residual material and, on the other hand, may come into material-stripping contact with the underside of the metering valve, the residual material taken up by the roller may preferably be removed from the roller surface at the opposite side to the take-up side by means of a doctor blade so that it is always a substantially cleaned surface region of the roller moving towards the residual material.

The invention further relates to a metering device for metering highly viscous, paste-like material, in particular printing inks, e.g. offset printing inks, comprising at least one metering valve, which is connectable to a material store and to which the material is supplied at high pressure, comprising a weighing device for determining the quantity of material discharged from the metering valve, comprising a control device for influencing the opening state of the metering valve as a function of the discharged quantity of material and comprising a device for removing the residual material which is left suspended from the metering valve after closure.

A metering device of said type, whose construction could correspond substantially to that of the device of EP 0 516 897 A1, is according to the invention improved in such a way that the device for removal of residual material comprises a roller, which may be driven rotatably about its longitudinal axis and is movable relative to the metering valve between a position of rest at a distance from the material exiting from the metering valve and an operating position in which the roller, with its longitudinal axis aligned substantially horizontally, is situated just below the metering valve and in contact with the residual material so that, as the roller rotates, the contact between residual material and roller surface occurs, which effects adhesion of the residual material to the upward-moving region of the roller surface.

By means of the metering device according to the invention, the residual material suspended from the metering valve after closure of said valve may be removed in the manner described above with reference to the metering method.

The roller may be held on a laterally displaceable carriage. Said carriage preferably has the shape of a trough, the roller projecting beyond the side wall of said trough nearer the metering valve. A doctor blade may be provided in the trough, said doctor blade for stripping away residual material being in engagement with the peripheral wall of the roller lying opposite the projecting part of the roller so that the detached residual material is received by the trough.

The trough may have a trough chamber, which is separate from the doctor blade and into which dips a rotatably drivable cleaning brush, whose axis of rotation is disposed parallel to the longitudinal axis of the roller and whose bristles upon displacement of the carriage beyond the operating position come into engagement with the underside of the metering valve having the outlet opening. The rotating cleaning brush is moistened with a solvent for the residual material to enable the residual material to be, on the one hand, easily separated from the metering valve and, on the other hand, flushed out of the cleaning brush.

A motor forming the rotary drive for the roller and the cleaning brush is preferably disposed on the carriage. The rotational speed of the motor is advantageously continuously variable to enable the rotational speed of the roller to be adapted to the properties of the material.

Since an easily ignitable solvent may be situated in the region of the carriage and since often the material too is highly inflammable, a pneumatic motor is advantageously used as a motor, said motor moreover enabling speed control in a simple manner by means of throttles or the like.

BRIEF DESCRIPTION OF THE DRAWINGS

The invention is described in greater detail below with reference to the drawings which illustrate an embodiment.

DESCRIPTION OF THE PREFERRED EMBODIMENT

Figure 1:
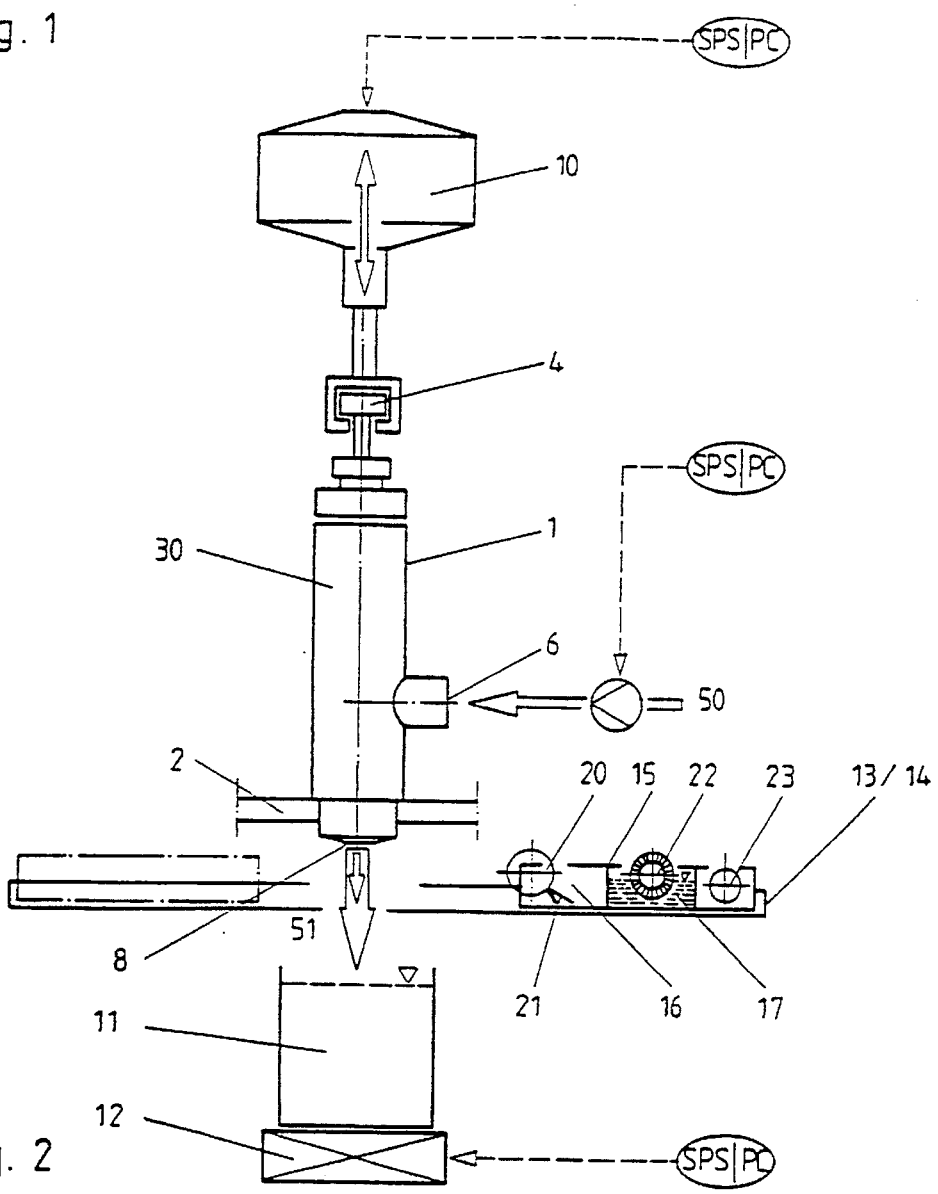
FIG. 1 is a diagrammatic partial view of a metering valve, below which are disposed a container and a carriage bearing the roller and a cleaning brush.
Figure 2:
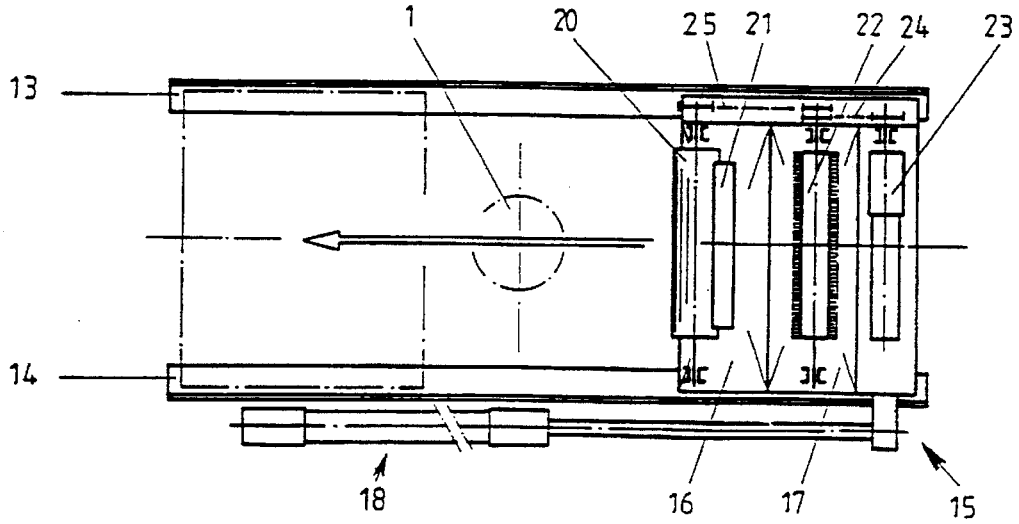
FIG. 2 is a plan view of the carriage according to FIG. 1.

The arrangement diagrammatically shown in FIG. 1 comprises a metering valve 1, whose housing 3 is fastened on a carriage plate 2 and whose operating device 10 is coupled to an operating part 4 of the metering valve 1 in the manner described, for example, in EP 0 516 897 A1. The material to be metered is supplied through a lateral inlet 6 to the metering valve 1 and, when the metering valve 1 is opened, exits at the underside of the housing 3 and is poured into a container 11 standing on a balance 12 and situated below the metering valve 1, which has been suitably positioned through displacement of the carriage plate 2. In the customary manner for such metering devices, the balance 12 is coupled to a computer, preferably a personal computer (indicated by SPS/PC) which, in accordance with the actual weight determined by the balance, controls the operating device 10 for the metering valve 1 as a function of the known properties of the material being discharged in such a way that the desired quantity of material 11 is discharged and the metering valve 1 subsequently closed.

To enable highly viscous, paste-like material having a viscosity in excess of 2000 pascal/sec, such as for example printing inks, in particular offset printing inks, to be discharged by such an arrangement, the material is delivered, e.g. by a known barrel-emptying device which feeds material out of a barrel by pushing a pressure plate down onto the barrel contents with a pressure in the order of magnitude of 100 bar, through a pipe to the inlet 6 of the metering valve 1 where it enters at a pressure of more than 50 bar. Given the presence of material in the metering valve 1, when the metering valve 1 is opened by the closing element 5 of the metering valve 1 being raised through activation of the operating device 10 (FIG. 3), the highly viscous, paste-like material 50 exits through the valve opening 7 thus formed in the valve housing 3 in the form of a material stream or strand 51 which has an outside diameter substantially corresponding to the minimum diameter of the valve opening 7. Once said material stream or strand 51 has filled the container 11 to the extent that the balance 12 determines a value approaching the desired end value, the operating device 10 effects a gradual closing of the closing element 5, with the result that the clear cross-section of the valve opening 7 is reduced in the manner indicated in FIG. 4. The material stream or strand 52 then has a diameter of a considerably reduced dimension, i.e. a smaller quantity of material per unit of time is discharged into the container 11.

Figures 3, 4, 5:
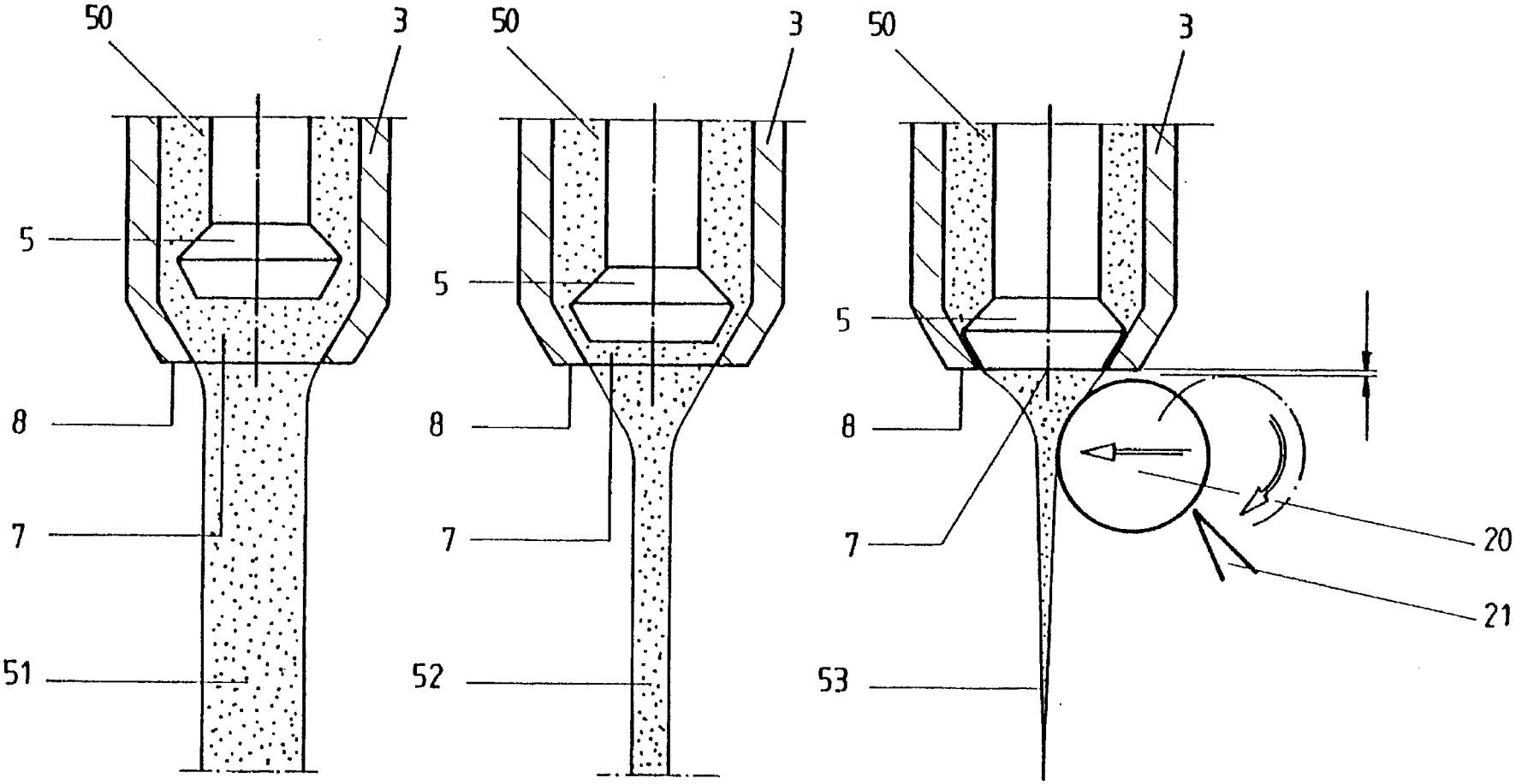
FIG. 3 is an extremely diagrammatic sectional view of the bottom part of the metering valve of FIG. 1 in its fully open state for discharging material.
FIG. 4 is a view corresponding to FIG. 3 of the metering valve in an open position which reduces the discharge of material.
FIG. 5 is a view corresponding to FIGS. 3 and 4 of the metering valve, closed after the discharge of material and having residual material suspended therefrom, and of the roller of FIGS. 1 and 2.

Upon closer approximation to the desired filling level of the container 11, the closing element 5 is closed to a greater extent and, shortly before the desired filling quantity is reached, a reciprocating movement of the closing element 5 is effected so that said element progressively approaches the closed position and, while so doing, also pumps small quantities of material 50 out of the valve opening 7 until the balance 12 determines metering of precisely the desired quantity of material into the container 11, whereupon the closing element 5 is held by the operating device 10 in the closed position according to FIG. 5.

However, since the material 50 being discharged is highly viscous and paste-like, residual material 53 still adheres to the underside of the metering valve 1 in the manner indicated in FIG. 5, said residual material being suspended in a sharply tapering, elongated form from the underside of the metering valve 1 and generally being rotationally symmetrical relative to the centre line 7' of the valve opening 7.

As FIG. 1 shows, a carriage 15 supported on two guide rails 13, 14 and driven by a pneumatic working cylinder 18 is provided below the metering valve 1 and is moved back and forth between the two positions indicated in FIG. 1. The carriage 15 is substantially in the shape of a trough having a trough region 17, which is usually filled with a solvent or is washed through by a solvent and in which a cylindrical cleaning brush 22 is rotatably disposed, whose bristles, on the one hand, lie at a distance above the bottom of the trough region 17 and dip into the solvent and whose bristles, on the other hand, project beyond the top edge of the trough region 17. Moreover, disposed in a further trough region 16 is a roller 20, e.g. a steel roller with a smooth cylindrical surface, which, at the side of the carriage 15 remote from the cleaning brush 22, projects to a slight extent laterally beyond the trough region 16. The roller 20 is supported with its longitudinal axis parallel to the longitudinal axis of the cleaning brush 22 and projects beyond the top edge of the trough region 16 and the trough region 17, although with the maximum generating line it is located in a horizontal plane slightly below the top generating line of the cylindrical arrangement of bristle tips of the brush 22. Thus, when the carriage 16 is displaced in the manner yet to be described between the two positions shown in FIG. 1, the roller 20 moves past the underside 8 of the metering valve 1 at a slight distance of about 1 to 2 mm below it, while the bristles of the brush 22 come into cleaning engagement with said underside 8.

A doctor blade 21 is fastened in the trough region 16 at the opposite side to the laterally projecting wall region of the roller 20 and is arranged in such a way that, when the roller 20 rotates in a clockwise direction (FIGS. 1 and 5), the doctor blade scrapes highly viscous, paste-like material adhering to the roller surface off said surface so that such material is retained in the chamber region 16.

During operation, the roller 20 and the brush 22 are driven via chains 24, 25 by the pneumatic motor 23 so that they rotate in a clockwise direction (FIG. 1), the rotational speed being continuously variable in such a way that the roller 20 is rotated at a suitable speed for the material to be metered, while the speed of the brush 22 is uncritical since the brush merely effects a cleaning process to be described below. In one application case, the roller 20 had a diameter of around 30 mm and was driven at a speed of 60 rpm.

When, as described above, material 50 is metered into the container 11 and at the end of the metering process, once the closing element 50 of the metering valve 1 has been closed, residual material 53 is suspended from the metering valve, the carriage 15 is moved out of the position according to FIG. 1, the position of rest of the roller 20, towards the centre line 7' of the valve opening 7 into a position, the operating position of the roller 20, in which the peripheral region of the rotating roller 20 projecting laterally beyond the trough region 16 comes into contact with the residual material 53, so that the roller 20 is situated in the position indicated in FIG. 5 or is moved into and then beyond said position. As a result of the upward movement of the peripheral region of the rotatingly driven roller 20 in contact with the residual material 53 and adhesion of such material to the roller surface, the residual material 53 is carried along by the roller surface in the direction of rotation and a kind of winding-on process for the residual material 53 occurs, whereby such material is drawn continuously up towards the roller 20 and is taken up by the roller 20 until the residual material 53 has been almost fully removed from the underside of the metering valve 1. During said "winding-on process", the residual material 53 which has been taken up by the roller 20 is simultaneously removed from the roller surface by the doctor blade 21 in the chamber region 16 so that the roller region coming once more into contact with the suspended residual material 53 is substantially free of material.

After said "winding-on process" by the roller 20, normally a very small quantity of residual material is left adhering to the metering valve 1, said quantity being all the smaller, the narrower the gap between the "winding-on" roller 20 and the underside 8 of the metering valve 1. However, such gap has to be large enough reliably to prevent residual material, which has been "wound" onto the roller 20, from sticking or being scraped off at the underside 8 of the metering valve 1.

Once the "winding-on process" is complete, the carriage 16 is displaced beyond the operating position of the roller 20 so that the rotatably driven cleaning brush 22 removes the residual material 53 still clinging to the underside of the metering valve 1, such process presenting no problems owing to the small quantity of residual material because this material is easily removed from the bristles of the brush 22 by the solvent provided in the trough region 17.

The carriage 15 is finally moved out of the left position indicated in FIG. 1 back into the illustrated right position so that it is in a position in which it may be moved back into the operating position of the roller 20 for the take-up of residual material.

We claim:

1. A method of cleaning a metering valve having an outlet side, so as to remove material suspended at the outlet side of the metering valve, comprising:

providing a roller for cleaning;

disposing the roller just below and to one side of the metering valve;

mounting the roller for rotation about a substantially horizontal longitudinal axis; and rotating the roller so as to bring a peripheral region of the roller undergoing a component of motion in a generally upward direction into contact with the suspended material.

2. The method according to claim 1 further comprising the steps of:

providing a doctor blade; and positioning the doctor blade adjacent the roller surface at a point remote from the point on the peripheral region of a roller which contacts the residual material in an upward direction, so as to remove at least a portion of the residual material carried by the roller.

3. A metering device for metering highly viscous, paste-like material including:

at least one metering valve having means for connection to a source of the material;

weighing means for determining the quantity of material discharged from the metering valve;

control means, responsive to the weighing means to control opening of the metering valve; and means for removing material which is left suspended from the metering valve after valve closure;

the improvement wherein the removal means comprises:

a roller having a surface and a longitudinal axis;

means for mounting the roller for rotation about the longitudinal axis;

means for moving the roller to the metering valve, between a rest position spaced from the path of material dispensed from the metering valve and an operating position in which the roller is located below the metering valve in contact with the residual material such that, with rotation of the roller, a first portion of the roller surface has a component of movement which is generally upwardly moving, the roller located in the operating position such that material suspended from the metering valve is contacted by the first portion of the roller surface and carried by the roller surface.

4. The metering device of claim 3 further comprising a carriage carrying the roller; and means for laterally displacing the carriage so as to move the roller between the rest position and the operating position.

5. The metering device of claim 4 wherein the carriage comprises a trough having first and second opposed side walls, with the first side wall located nearer the metering valve than the second side wall;

a doctor blade located adjacent the second side wall so as to strip away material carried on the roller surface; and the roller positioned with respect to the first side wall such that a portion of the roller surface extends outside of the trough.

6. The metering device according to claim 5 wherein:

the trough defines a trough chamber holding a solvent for the suspended material;

a cleaning brush having a rotation axis;

means for mounting the cleaning brush for rotation about the rotation axis, with the rotation axis being generally parallel to the longitudinal axis of the roller; and the cleaning brush containing bristles which contact the solvent in the trough chamber and which carry the solvent to the underside of the metering valve.

7. The metering device according to claim 6 further comprising a motor carried on the carriage and coupled to the roller and the cleaning brush for rotational driving of the roller and the cleaning brush.

8. The metering device according to claim 7 wherein the motor has a continuously variable output speed.

9. The metering device according to claim 8 wherein the motor is a pneumatic motor.

10. The metering device of claim 3 wherein the roller has an outer cylindrical surface.

11. The metering device according to claim 10 wherein the roller includes a metallic cylinder which includes the outer surface.

* * * * *